United States Patent [19]

Evans

[11] Patent Number: 4,484,642

[45] Date of Patent: Nov. 27, 1984

[54] REVERSE ACTION AUGER

[75] Inventor: Francis C. Evans, Kamloops, Canada

[73] Assignee: Legato Drilling Ltd., Kamloops, Canada

[21] Appl. No.: 580,784

[22] Filed: Feb. 22, 1984

Related U.S. Application Data

[63] Continuation of Ser. No. 347,385, Feb. 2, 1982, abandoned.

[30] Foreign Application Priority Data

Jun. 10, 1981 [CA] Canada ..... 379484

[51] Int. Cl.[3] ..... E21B 7/00

[52] U.S. Cl. ..... 175/65; 175/323

[58] Field of Search ..... 175/57, 65, 19, 21, 175/323, 324, 217, 394, 310, 297; 299/87; 294/86.1, 86.12, 86.26

[56] References Cited

U.S. PATENT DOCUMENTS

| | | | |
|---|---|---|---|
| 1,659,327 | 2/1928 | Montgomery | 175/323 |
| 1,846,177 | 2/1932 | Bascom et al. | 175/323 |
| 2,178,194 | 10/1939 | Williams | 175/323 |
| 2,815,241 | 12/1957 | Bundy | 294/86.12 |
| 3,422,913 | 1/1969 | Young, Jr. | 175/323 |
| 3,440,886 | 4/1969 | Meeker | 175/323 |

FOREIGN PATENT DOCUMENTS

| | | |
|---|---|---|
| 153493 | 4/1953 | Australia . |
| 212811 | 9/1956 | Australia . |

*Primary Examiner*—James A. Leppink
*Assistant Examiner*—Hoang C. Dang
*Attorney, Agent, or Firm*—Jones, Tullar & Cooper

[57] ABSTRACT

The present invention provides an improved auger for use in drilling holes in the earth. The auger has a helical flight which is wound in a direction opposite to the normal direction of rotation of the auger. Thus an auger which is to be rotated in a clockwise manner has its flight directed in a counterclockwise manner. As the auger enters the earth with its clockwise rotation the tailings created thereby encounter a downhole force created by the reverse flight and they are forced outwardly from the auger so that they enter natural fissures or porous zones of the earth along the wall of the hole. No tailings reach the surface of the earth to create environmental problems. When water is used, as in drilling deeper as for seismic exploration, the water and tailings enter the wall of the hole and create a form of cement which prevents wall collapse. Drilling is faster and more economical, with fewer breakdowns, than with conventional augers.

2 Claims, 4 Drawing Figures

REVERSE ACTION AUGER

This application is a continuation of application Ser. No. 347,385, filed Feb. 2, 1982, abandoned.

The present invention relates in general to the drilling of the earth and in particular to an improved auger for such drilling.

BACKGROUND OF THE INVENTION

It is conventional to use an auger when drilling into the earth whether the hole to be produced is shallow as for a post hole, or deep, as for a well or for seismic exploration. For such conventional drilling the flight of the auger has its helix oriented in the same direction as the rotation of the auger. Thus a drill or auger which rotates in the clockwise direction has a right-hand or clockwise flight. With this type of conventional auger the flight tends to pull the auger down into the earth and the material (tailings) removed from the hole is forced up the auger to the surface by the flight. If the auger becomes clogged by the material it is necessary to lift the auger from the hole for cleaning. As the hole becomes deeper and/or dense material such as clay is encountered it becomes progressively more difficult to remove the auger for cleaning. Also the hole wall tends to continuously collapse, making removal of the auger more difficult, making drilling more difficult or possibly resulting in a broken auger.

When drilling bore holes for seismic exploration or when drilling deeper, as for a well, it is conventional to use a drill string made up of a plurality of lengthsdrilling mud passes downwardly through the drill string to the drill bit secured to the downhole end of the lowermost drill steel so as to lubricate and cool the drill bit and to help carry the tailings upwardly to the surface. The same problems resulting from clogging of the auger, as discussed above, apply to drill strings as well.

When drilling for seismic exploration or for wells there is an even greater problem, represented by the talings and mud brought to the surface by the auger. The tailings and mud are distributed about the hole on the surface and are considered to be unacceptable by many enviromental protection agencies or groups. The tailings and mud, especially if chemically treated as is often the case, can damage lakes and streams. Chemically treated mud can also leak into underground streams unknown to the operators, and if the streams discharge into lakes or rivers it is often impossible to determine the sorurce of the pollution. A large sub-industry has developed recently solely for the purpose of cleaning up drilling sites and this of course increases greatly the cost of a drilling operation.

SUMMARY OF THE INVENTION

The present invention overcomes the problems enumerated above by providing a drill steel or auger in which the flight is directed oppositely to the direction of auger rotation. Thus in the present invention an auger or drill steel which rotates in a clockwise direction has a left-hand, or counter-clockwise flight.

Such an auger at first appears to be unworkable since the flight is applying forces which would tend to remove the auger from the hole. However, when dealing with a drill string, for example, which has a separate bit at the downhole end, it is in fact the bit, rather than the flight, which cuts into the earth. A downhole directed weight is applied by the drill rig and hence the drill string will enter the earth and will bore a hole as desired. Water may be forced down the hollow drill string as in conventional drilling to exit at the bit, keeping the bit cool and lubricated. The water mixes with the tailings in the vicinity of the drill bit, as is conventional. However, the reversed flight now applies essentially a downhole force to the tailings and, since they cannot move upwardly in the hole they are in fact forced in a generally radial direction against the walls of the hole. The tailings and the mud created thereby under the back (downhole) pressure created by the flight are forced into the natural fissures, cracks or porous zones of the surrounding earth and the surrounding earth absorbs both the water and the tailings or mud. Nothing reaches the surface.

The present invention provides many advantages over the prior art. When the water and tailings are forced in to the material surrounding the hole a strong tight wall of a consistency not unlike cement is created. This greatly reduces the tendency towards collapse of the bore wall, which collapse would trap a conventional drill steel causing it to break. Should the bore wall collapse with the present invention the reversed flight would try to screw the drill string out of the hole. By doing this the forces created actually crush the collapsed material reducing the partical size and making it easier for that material to be forced back into the bore wall. Drilling can then continue without fear of drill steel breakage.

Most importantly, as indicated above, no tailings or mud reach the surface. This of course means that every hole will be clean at the surface and there will be no environmental problems. Also it is not necessary to use chemically treated water and the amount of water required is considerably less since recirculation to the surface is avoided.

During drilling the bit and drill steel will encounter layers of different density and porosity. When drilling in unconsolidated material the porosity is high and the tailings are coarse. However the high porosity means that the coarser tailings are readily accepted. Similarly in granite or other consolidated material where the porosity is less the tailings will be very fine and may still enter the surrounding material to form a solid bore wall.

In summary of the above, therefore, the present invention may be broadly defined as providing an auger for use in drilling into the earth under rotative movement in one direction of rotation, the auger having a helical flight extending from one end to the other, the flight being defined as a helix winding in a direction opposite to said one direction of rotation.

Additionally, the present invention defines a length of drill steel for use in drilling into the earth under rotative movement in one direction, the drill steel comprising: an elongated cylindrical drill stem having means at each end for connecting the drill steel to adjacent lengths of drill steel or to a drill bit, and a helical auger flight extending from one end of the drill stem to the other end thereof, the flight being secured to the outer surface of the drill stem and winding therealong in a direction opposite to said one direction of rotation.

DESCRIPTION OF THE PREFERRED EMBODIMENT

Figure 1:
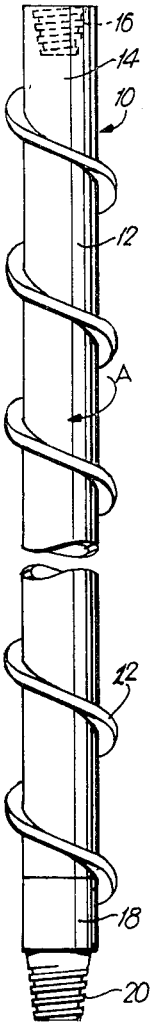
FIG. 1 shows a drill steel of the present invention.

FIG. 1 of the drawings shows the reverse action auger 10 of the present invention in terms of its constituent components. The auger 10 is illustrated as made up of a stem pipe 12 typically cut to the appropriate length from 2 inch diameter 4041 hot rolled tubing and having a wall thickness of 0.375 inches. This leaves a central bore along the tubing in the order of 1¼ inches. At each end the stem pipe is provided with means for attaching each length of pipe to an adjacent length, a coupler or a drill bit. Typically a box end fitting will be provided at each end of the stem pipe, the box end 14 for the upper end having a female failing thread 16 and the box end 18 for the lower end having a male failing thread 20. The box ends are also formed (machined) from 2 inch diameter X 0.375 inch wall 4041 hot rolled tubing so as to smoothly mate with the stem pipe itself. The box ends are in turn welded into the drill stem pipe 12 to establish the full length of the auger. Lengths of 3, 5, 10 or 15 feet are conventional.

The significant component of the auger of the present invention is the reverse action flight 22 which, as is seen in FIG. 1 is wrapped down the pipe in a direction opposite to the direction of pipe rotation as shown by the arrow A. The flight is made from ½ by ¼ inch flat bar stock wrapped and welded in a spiral manner along and to the outer surface of the stem pipe in what is shown as a left hand helix. It is suggested that the helix be formed on 4 inch centers although that dimension is not critical.

A mechanism for drill stem breakout has not been shown but it is understood that any of the accepted types, such as the Sewel or the Top drive, could be used.

Figure 2:
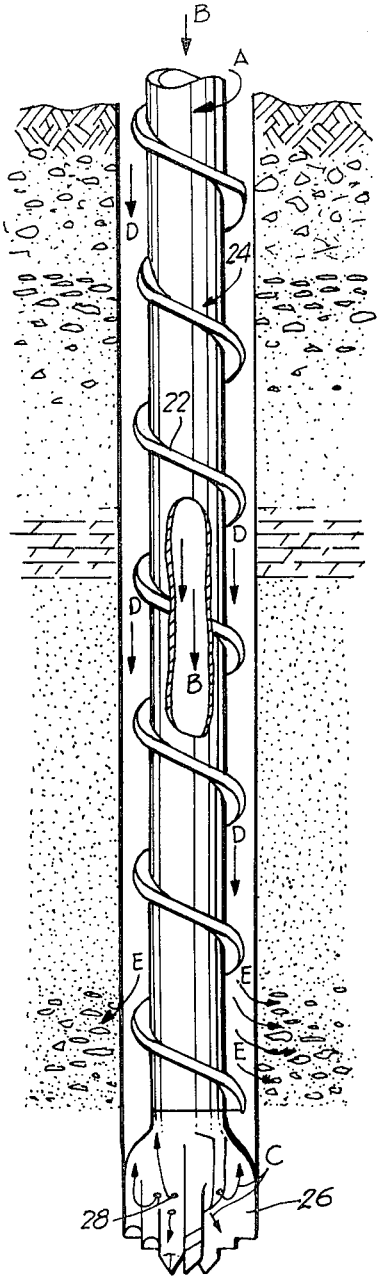
FIG. 2 shows a drill string utilizing the present invention in a drilling environment.

FIG. 2 shows a drill string 24 made up of a plurality of individual stem pipes or lengths of drill steel. The scale of FIG. 2 is expanded with respect to the drill string and compressed with respect to the earth formations to aid in full comprehension of the processes involved.

The drill string 24 is connected at the top to a drill rig (not shown) which applies rotative torque to achieve clockwise rotation as shown by the arrow A, and which also applies a downhole force to the drill string and thereby to the rotary bit 26 connected to the downhole end of the lowermost length of drill steel. The rig also pumps water down through the hollow interior of the drill string 24 (arrows B), the water exiting through appropriate openings or holes 28 in the drill bit 26 (arrows C) at the bottom of the hole. So far everything is completely conventional.

As the drill string rotates clockwise (arrow A) the water issuing from the drill bit (arrows C) encounters a high back pressure (arrows D) caused by the reverse thrust of the flight 22. There is very little clearance between the outer edge of the flight and the bore hole wall since the diameter of the drill bit is substantially equal to the overall diameter of the auger and hence there is little chance for the tailings or residue created by the drill bit to work their way upwardly past the flights. As a result of the back pressure generated by the flights the tailings and water are forced into natural fissures or porous zones in the earth formaton (arrows E) and the porosity of the formations absorbs both the water and the tailings. This action creates a tight wall in the earth formations along the bore wall having a consistency not unlike cement which tends to prevent any collapsing of the bore wall. An unchecked wall collapse could trap a drill string in the hole causing fracture of the string as it rotates and binds in the collapsed material. With the present invention, even if there should be a collapse of the wall, the reverse action flights would tend to try to screw the drill string out of the hole, alleviating the forces which would tend to break a conventional drill string since the conventional drill string would still be trying to advance into the hole. Furthermore, the action of the reverse flight in effect further crushes any collapsed material making it finer and thus making it easier for the finer crushed material to be forced into the wall of the hole. Drilling can continue as if no collapse had occurred.

One particular advantage to the present invention as seen from FIG. 2 is that there is little or no chance for tailings to reach the surface, a problem as enumerated previously with conventional drilling systems. Even if tailings and water do migrate up the bore hole they will be constantly subjected to the downhole forces applied by the reverse action flights and eventually they will encounter a formation of sufficient porosity to accept them. Also, the longer the tailings remain in the borehole the more they will be crushed by the flights and the easier it will be for the crushed tailings to enter natural fissures in the earth formations. Since no tailings reach the surface the ecological damage to the environment is absolutely minimized, the drilling area being unscarred by tailings and/or mud. Also, since there is no cleanup required when drilling is complete the overall costs are reduced, making the drilling operation more economical. When the operator is ready to leave the drill site all he has to do is plug the hole (conventional) and move on to the next site.

Experiments with an auger according to the present invention have shown its worth. For example, in a 12 hour shift using conventional right-hand augers, a crew is considered efficient if 25 to 30 seismic exploration holes of about 60 feet in depth can be produced. Using augers in accordance with the present invention (left-hand augers) the same crew was able to produce over 65 seismic exploration holes in a 12 hour shift. Thus it is seen that by avoiding the problems associated with conventional augers it is possible to greatly increase the drilling efficiency and to benefit as well from the environmental advantages obtainable therewith.

Figure 4:
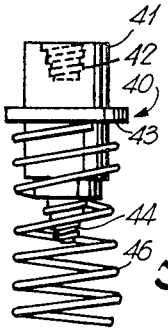
FIG. 4 shows an overshot usuable with the present invention.
Figure 3:
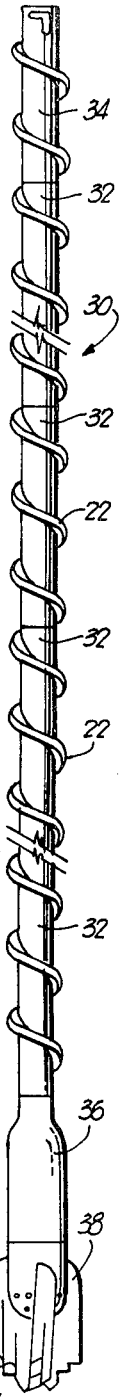
FIG. 3 shows other components of a drill string according to the present invention.

FIGS. 2 and 4 are intended to show the other components which are conventionally known and are used with the present invention. FIG. 3 shows a drill string 30 made up of a plurality of lengths 32 of drill steel made in accordance with the present invention each having a reverse action flight 22. These lengths are typically 5, 10 or 15 feet in length and the flights are oriented such that the lower end of one flight will run smoothly into the upper end of the flight of the subjacent drill steel when the two steels are firmly mated together. At the top a "cheater" length of 3 feet is used, the cheater taking up the space between the rig and the surface of the ground, thereby making the depth of the hole easy to calculate by adding up the lengths of drill steel used. The cheater also takes the main downhole wear and is cheaper to replace than other longer lengths.

Item 36 is a coupler which is used only if an oversize drill bit, such as 38 is used. For example, if a normal 3½ inch diameter bit is used, a coupler is not required.

However, if a 4½ inch diameter bit is used than a coupler such as 36 would be inserted between the bit 38 and the lowermost end of the downhole drill steel. The drill bits of course are commercially available standard bits.

Should a drill string become trapped in the hole (less likely with the present invention than with conventional augers) then an overshot as shown in FIG. 4 would be used. First of all the string would be reverse rotated to break the connection between the trapped steel and the untrapped string portion. In this regard, should a length become trapped the action of the auger according to the present invention makes it very easy to break a connection since, when trapping does occur the string tends to screw itself out of the hole and no additional forces are applied to the threaded connections between adjacent lengths of drill steel. With conventional augers when a length becomes trapped the continued rotation tends to drive the string deeper into the hole and this has the effect of tightening the threaded connections, making it more difficult to break the connection between the trapped length and the rest of the drill string.

When the untrapped length of drill steel has been removed from the hole an overshot as shown in FIG. 4 is connected to the lowermost end of the untrapped length. The overshot is essentially a coupler, such as 40, having a female box thread 42 in one end thereof and a male threaded member, such as a tap 44 at the other end thereof. An annular plate 43 is welded to the coupler body 41 intermediate the ends thereof and a helical spring member 46, having a right hand thread is welded to the coupler body 41 and the plate 43 so as to extend downwardly below the overshot 40. The spring 46 has a constant diameter along its length and its inside diameter is slightly greater than the outside diameter of an auger flight. In use the overshot member 40 is connected via the thread 42 to the male thread of the lowermost length of untrapped steel and is lowered into the bore hole. The spring 46 will engage and center itself around the outer edge of flight 22 of the uppermost end of the trapped length and thus centers the overshot 40 with respect to the trapped drill steel. Continued downward movement brings the tap into engagement with the female box end of the trapped length and rotation of the drill string allows the tap to thread itself into the uppermost end of trapped steel so that a stong connection is made. The trapped length can then be pulled from the hole.

In the event that loose soil or soft ground has fallen from the wall of the bore hole during the process of retrieving the trapped length, such debris will pass outward between the coils of the spring 46 as it rotates downwardly into the bore hole.

It is understood that the foregoing description provides the best mode of effecting the present invention, but that variations therein could occur to a skilled person in the art. For example while the invention has been described in terms of drill steel having an auger flight applied to a hollow drill stem it is clear that the advantages of the present invention would also accrue to other augers such as those used for the preparation of post holes, wherein a solid central shaft is used. The reverse action of the auger flight would force the dug earth outwardly so that it is compacted against or enters into the earth surrounding the hole, thereby eliminating the tailings which would otherwise accumulate at the surface. Such tailing are especially burdensome to the person drilling holes in a lawn since the tailings if left for a day or so can destroy the grass, and since the homeowner usually does not have a disposal site for the tailings close to hand. These problems would be eliminated by an auger constructed with a reverse flight in accordance with the present invention. Thus the protection to be afforded the present invention should be determined from the claims appended hereto.

The embodiments of the invention in which an exclusive property or privilege is claimed are defined as follows:

1. A method of drilling a casingless borehole in the earth comprising the steps of:

(a) connecting one end of a length of drill steel to above-ground drive means adapted to rotate in a first rotary direction and connecting the other end of the drill steel to a drill bit, the drill steel including an elongated hollow drill stem having a continuous helical auger flight extending the full length thereof, said auger flight being secured to the outer surface of said drill stem and winding therearound in a second direction which is opposite to said first rotary direction, said auger flight having a diameter which is substantially equal to that of said drill bit;

(b) operating said drive means to rotate said drill steel and drill bit in said first rotary direction to advance said bit and steel into the earth;

(c) pumping drilling fluid under pressure into the hollow interior of said drill steel to exit through openings in said drill bit into the borehole created thereby; and (d) continuing said pumping and rotating in said first direction, whereby tailings produced by said drill bit and said fluid under pressure encounter said auger flight and are forced, by fluid pressure and by downward forces created through rotation of said auger flight, to flow generally radially outwardly from the drill stem into natural fissures and porous zones of the surrounding earth formations, such that drilling fluid and tailings do not reach the top of the borehole.

2. The method of claim 1 including the step of connecting additional lengths of drill steel between said drive means and the uppermost length of drill steel previously connected thereto.

* * * * *